United States Patent [19]

Hauge et al.

[11] Patent Number: 4,961,246

[45] Date of Patent: Oct. 9, 1990

[54] VACUUM CLEANING DEVICE

[76] Inventors: Ronald Hauge; Carol Hauge, both of Rte. 8, Box 109, Mankato, Minn. 56001

[21] Appl. No.: 329,968

[22] Filed: Mar. 29, 1989

[51] Int. Cl.[5] ..... A47L 9/06

[52] U.S. Cl. ..... 15/401; 15/323; 15/353; 15/300.1

[58] Field of Search ..... 15/300 A, 320, 353, 15/401, 323

[56] References Cited

U.S. PATENT DOCUMENTS

| | | | |
|---|---|---|---|
| 1,763,397 | 6/1930 | Hutchinson | 15/323 X |
| 2,522,882 | 9/1950 | Lofgren | 15/323 X |
| 2,616,517 | 11/1952 | Beck | 15/323 X |
| 2,622,254 | 12/1952 | Mendelson | 15/320 X |
| 2,893,047 | 7/1959 | Swihart | 15/300 A X |
| 3,118,165 | 1/1964 | Meyerhoefer | 15/320 X |
| 3,210,792 | 10/1965 | Sassano | 15/401 |
| 3,277,511 | 10/1966 | Little et al. | 15/320 |
| 3,571,841 | 3/1971 | Crouser | 15/401 |
| 3,721,071 | 3/1973 | Mueller et al. | 55/360 |
| 3,939,518 | 2/1976 | Whitney | 15/320 X |
| 4,191,590 | 3/1980 | Sundheim | 134/21 |
| 4,222,145 | 9/1980 | Lowder | 15/353 |
| 4,233,706 | 11/1980 | Kauffeldt | 15/300 A |
| 4,244,080 | 1/1981 | Wessel | 15/401 X |
| 4,314,385 | 2/1982 | Wimsatt et al. | 15/321 |
| 4,483,041 | 11/1984 | Waldhauser et al. | 15/320 X |
| 4,595,420 | 6/1986 | Williams et al. | 134/6 |
| 4,723,337 | 2/1988 | Ellison et al. | 15/300 A |

*Primary Examiner*—Chris K. Moore

*Attorney, Agent, or Firm*—Jerry T. Kearns

[57] ABSTRACT

A vacuum cleaning device includes a cleaning cart designed for use by janitorial service workers. The cleaning cart includes a plurality of compartments formed in an open upper portion of a generally rectangular housing for storage of cleaning supplies and utensils. The cart also includes a trash receptacle for use by janitorial service workers when emptying trash cans. A pair of vacuum motors located in a lower portion of the housing are connected by conduits to a squeegee assembly suspended beneath the housing. The motors are of the type convertible between wet and dry operation. The vacuum motors are powered by a plurality of rechargeable batteries within the housing. The squeegee assembly is selectively adjustable by an elongated rod extending through the housing, and utilizes replaceable cartridges to renew the wiping elements.

1 Claim, 5 Drawing Sheets

VACUUM CLEANING DEVICE

BACKGROUND OF THE INVENTION

1. Field of the Invention

The present invention relates to vacuum cleaning devices, and more particularly pertains to a new and improved vacuum cleaning device incorporated in a cleaning cart for use by janitorial service workers. Conventionally, floors and commercial buildings such as groceries, restaurants and office buildings have been cleaned by first utilizing a manually pushed dust mop followed by cleaning with a rotary scrubber. This method of cleaning is unsatisfactory because the dust mop pushes the dirt across the floor, leaving a film which causes streaks when the rotary floor scrubber is utilized to polish the floor. While commercial vacuuming devices are well known, they require a long and cumbersome electrical cord and are bulky and difficult to transport. In order to overcome this problems, the present invention provides a transportable cleaning cart which includes a pair of battery powered vacuuming motors convertible between wet and dry operation.

2. Description of the Prior Art

Various types of vacuum cleaning devices are known in the prior art. A typical example of such a vacuum cleaning device is to be found in U.S. Pat. No. 3,721,071, which issued to H. Mueller et al on Mar. 20, 1973. This patent discloses a sealed and grounded electric motor housing provided with a castered supporting dolly. U.S. Pat. No. 4,191,590, which issued to J. Sundheim on Mar. 4, 1980, discloses a device for cleaning surfaces using a high velocity stream of cleaning fluid. The device includes a wheeled cart having a vacuum pick up system for recirculating the cleaning fluid. U.S. Pat. No. 4,222,145, which issued to D. Lowder on Sept. 16, 1980, discloses a vacuum cleaning device in which a wheeled carriage supports a plurality of different sized collection tanks on a pivot support rod extending between upward extending portions of a handle frame mounted on the carriage base. The rear of each of the tanks includes a transverse groove dimensioned to slip on to the pivot support rod. The tanks may be pivoted about the support rod to dump the contents contained therein. U.S. Pat. No. 4,314,385, which issued to J. Wimsatt et al on Feb. 9, 1982, discloses a carpet cleaning system which is convertible between a vacuum cleaning configuration and a liquid cleaning configuration. U.S. Pat. No. 4,595,420, which issued to R. Williams et al on June 17, 1986, discloses a mobile carpet cleaning machine which is propelled over the carpet to be cleaned. The device includes an elongated cylindrical brush, a vacuum system with a floating vacuum head and a blower. In operation, the cylindrical brush is set into a rotating motion and engages the underlying carpet. A cleaning solution is sprayed onto the rotating brush which in turn transfers the solution onto the underlying carpet. The vacuum head then passes over the carpet directly behind the rotating brush and effectively picks up a combined mixture of air and cleaning fluid.

While the above mentioned devices are suited for their intended usage, none of these devices disclose a cleaning cart having a plurality of compartments for collecting trash and storing cleaning supplies and utensils in combination with a battery powered vacuum cleaning system. Additionally, none of the aforesaid devices disclose the provision of a combined utility cleaning cart and vacuuming system with a vertically adjustable squeegee which is selectively replaceable for wet or dry operation. Inasmuch as the art is relatively crowded with respect to these various types of vacuum cleaning devices, it can be appreciated that there is a continuing need for and interest in improvements to such vacuum cleaning devices, and in this respect, the present invention addresses this need and interest.

SUMMARY OF THE INVENTION

In view of the foregoing disadvantages inherent in the known types of vacuum cleaning devices now present in the prior art, the present invention provides an improved vacuum cleaning device. As such, the general purpose of the present invention, which will be described subsequently in greater detail, is to provide a new and improved vacuum cleaning device which has all the advantages of the prior art vacuum cleaning devices and none of the disadvantages.

To attain this, a representative embodiment of the concepts of the present invention is illustrated in the drawings and makes use of a vacuum cleaning device including a cleaning cart designed for use by janitorial service workers. The cleaning cart includes a plurality of compartments formed in an open upper portion of a generally rectangular housing for storage of cleaning supplies and utensils. The cart also includes a trash receptacle for use by janitorial service workers when emptying trash cans. A pair of vacuum motors located in a lower portion of the housing are connected by conduits to a squeegee assembly suspended beneath the housing. The motors are of the type convertible between wet and dry operation. The vacuum motors are powered by a plurality of rechargeable batteries within the housing. The squeegee assembly is selectively adjustable by an by an elongated rod extending through the housing, and utilizes replaceable cartridges to renew the wiping elements.

There has thus been outlined, rather broadly, the more important features of the invention in order that the detailed description thereof that follows may be better understood, and in order that the present contribution to the art may be better appreciated. There are, of course, additional features of the invention that will be described hereinafter and which will form the subject matter of the claims appended hereto. In this respect, before explaining at least one embodiment of the invention in detail, it is to be understood that the invention is not limited in its application to the details of construction and to the arrangements of the components set forth in the following description or illustrated in the drawings. The invention is capable of other embodiments and of being practiced and carried out in various ways. Also, it is to be understood that the phraseology and terminology employed herein are for the purpose of description and should not be regarded as limiting. As such, those skilled in the art will appreciate that the conception, upon which this disclosure is based, may readily be utilized as a basis for the designing of other structures, methods and systems for carrying out the several purposes of the present invention. It is important, therefore, that the claims be regarded as including such equivalent constructions insofar as they do not depart from the spirit and scope of the present invention.

Further, the purpose of the foregoing abstract is to enable the U.S. Patent and Trademark Office and the public generally, and especially the scientists, engineers and practitioners in the art who are not familiar with patent or legal terms or phraseology, to determine quickly from a cursory inspection the nature and essence of the technical disclosure of the application. The abstract is neither intended to define the invention of the application, which is measured by the claims, nor is it intended to be limiting as to the scope of the invention in any way.

It is therefore an object of the present invention to provide a new and improved vacuum cleaning device which has all the advantages of the prior art vacuum cleaning devices and none of the disadvantages.

It is another object of the present invention to provide a new and improved vacuum cleaning device which may be easily and efficiently manufactured and marketed.

It is a further object of the present invention to provide a new and improved vacuum cleaning device which is of a durable and reliable construction.

An even further object of the present invention is to provide a new and improved vacuum cleaning device which is susceptible of a low cost of manufacture with regard to both materials and labor, and which accordingly is then susceptible of low prices of sale to the consuming public, thereby making such vacuum cleaning devices economically available to the buying public.

Still Yet another object of the present invention is to provide a new and improved vacuum cleaning device which provides in the apparatuses and methods of the prior art some of the advantages thereof, while simultaneously overcoming some of the disadvantages normally associated therewith.

Still another object of the present invention is to provide a new and improved vacuum cleaning device which includes a utility cleaning cart having receptacles for collecting trash and storing cleaning supplies and utensils.

Yet another object of the present invention is to provide a new and improved vacuum cleaning device with a rechargeable battery power source.

Even still another object of the present invention is to provide a new and improved vacuum cleaning device which is convertible between wet and dry operation and includes a vertically adjustable squeegee, having replaceable wiping cartridges.

These together with other objects of the invention, along with the various features of novelty which characterize the invention, are pointed out with particularity in the claims annexed to and forming a part of this disclosure. For a better understanding of the invention, its operating advantages and the specific objects attained by its uses, reference should be made to the accompanying drawings and descriptive matter in which there are illustrated preferred embodiments of the invention.

BRIEF DESCRIPTION OF THE DRAWINGS

The invention will be better understood and objects other than those set forth above will become apparent when consideration is given to the following detailed description thereof. Such description makes reference to the annexed drawings wherein.

DESCRIPTION OF THE PREFERRED EMBODIMENT

Figure 1:
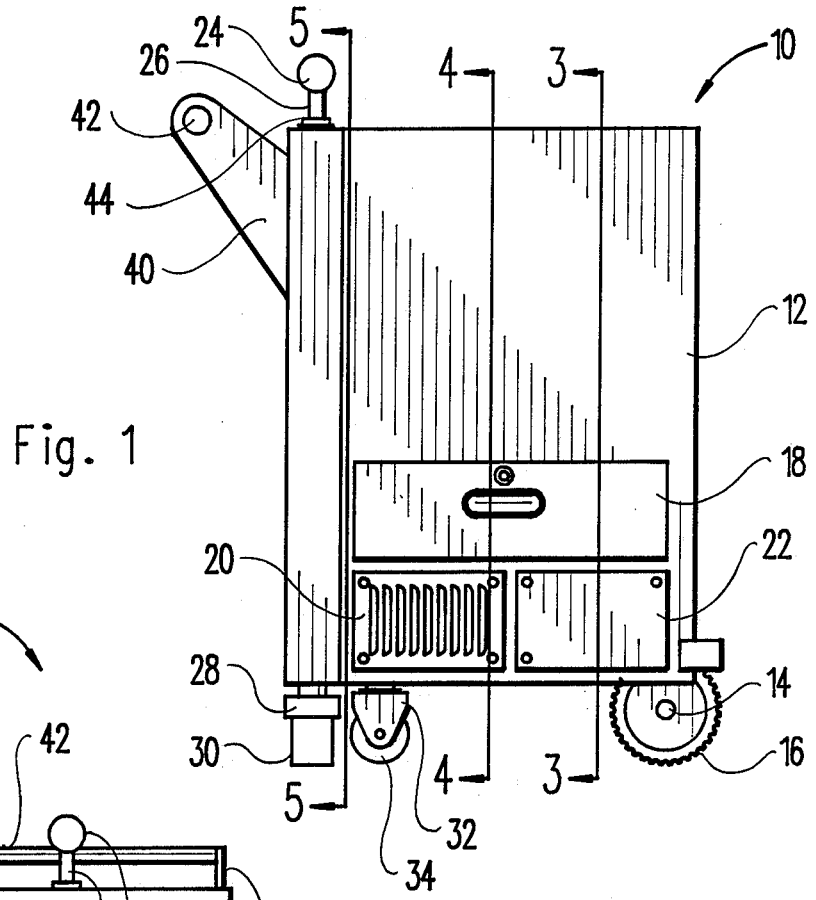
FIG. 1 is a side view of the vacuum cleaning device of the present invention.

With reference now to the drawings, and in particular to FIG. 1 thereof, a new and improved vacuum cleaning device embodying the principles and concepts of the present invention and generally designated by the reference numeral 10 will be described.

More specifically, it will be noted that the first embodiment 10 of the invention includes a generally rectangular housing 12 having a bottom surface provided with four rotatably mountable wheels. A first pair of wheels 16 are rotatably mounted on an axle 14 adjacent a front bottom edge of the housing or cart 12 and a second pair of wheels 34 are rotatably mounted in casters 32 adjacent a back bottom edge of the housing or cart 12. A laterally movable clean out drawer 18 is provided in a lower portion of the housing 12. Access plates 22 and 20 are provided for batteries and vacuum motors received within the lower bottom portion of the housing 12. An elongated rod 26 having a top handle portion 24 extends vertically through a back wall portion of the housing 12 and terminates in a carrier 28 for an elongated, generally rectangular squeegee assembly 30. A pair of suction intake apertures are formed in the bottom portion of the squeegee assembly 30 and are each coupled with conduits connecting them to one of two vacuum motors within the housing 12. A handle bar 42 is mounted between two vertically aligned mounting brackets 40 extending from a back wall of the housing 12.

Figure 2:
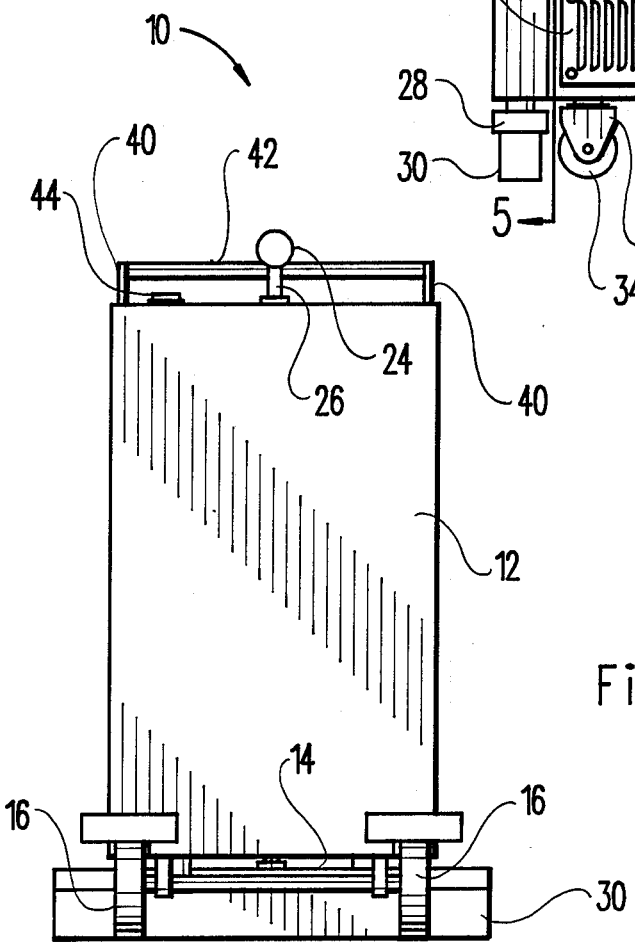
FIG. 2 is a front view of the vacuum cleaning device of the present invention.

FIG. 2 illustrates a front view of the vacuum cleaning device of the present invention. Rubber bumpers 70 may be provided on the housing 12 for protecting building wall surfaces from damage. A switch 44 is provided adjacent a top back edge of the housing 12 and is operatively connected for selectively actuating two vacuum motors within the housing 12. The vacuum motors are connected to suction intake apertures in the squeegee assembly which is suspended beneath the cart or housing 12. The squeegee 30 may comprise felt strips on a replaceable cartridge for use in dry vacuuming operations or may utilize a different cartridge with rubber rectangular strips for use during wet vacuuming operations. The squeegee assembly 30 may be vertically adjusted by manipulation of the elongated rod 26 by the knob 24. A suitable detent mechanism may be provided for securing the rod 26 in adjusted position, or a wing nut type set screw may be utilized to bear against the sidewall of the rod 26, to clamp it in an adjusted position. Alternatively, the rod 26 may be provided with external threads cooperating with a threaded collar for allowing selective threaded adjustment of the rod 26.

Figure 3:
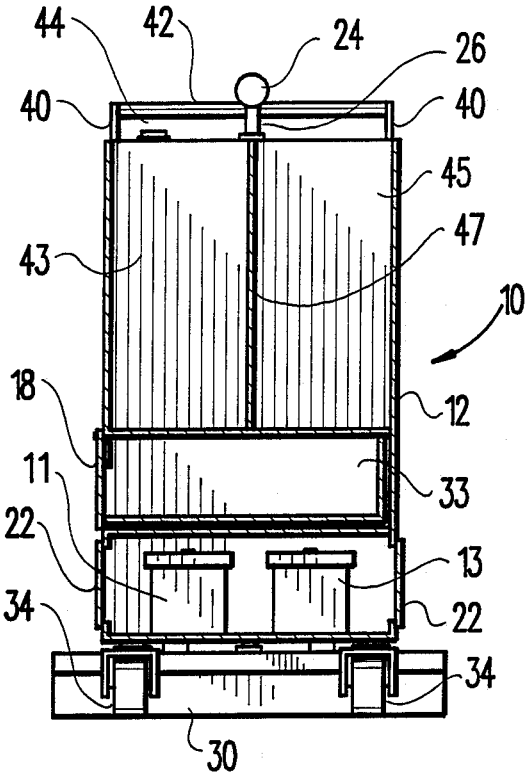
FIG. 3 is a longitudinal cross sectional view, taken along line 3—3 of FIG. 1.

FIG. 3 illustrates a cross sectional view, which is taken along line 3—3 of FIG. 1. A pair of compartments 43 and 45 are formed by a vertical partition 47. The compartments 43 and 45 may be utilized for storage of cleaning utensils such as brooms and mops and may also be provided with a garbage liner for use in collecting trash. The lateral clean out or dust collection drawer 18 has an interior compartment 33 adapted to receive the exhaust from a pair of vacuum motors within a lower portion of the cart or housing 12. A plurality of batteries 11 and 13 are disposed in a battery storage compartment accessed by side cover plates 22.

Figure 4:
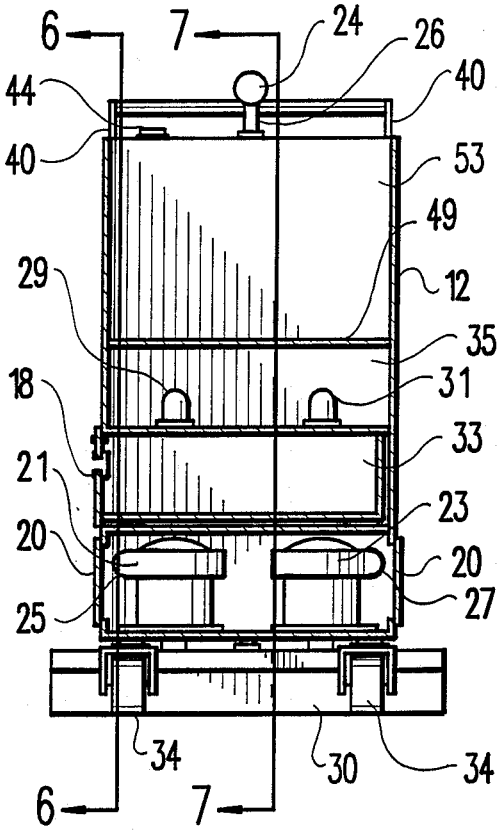
FIG. 4 is a longitudinal cross sectional view, taken along line 4—4 of FIG. 1.

As shown in FIG. 4, a pair of vacuum motors 21 and 23 are connected by respective discharge conduits 29 and 31 extending through an intermediate compartment 35 to the dust collection compartment 33. Intake conduits 25 and 27 are connected to the squeegee assembly 30 suspended beneath the bottom surface of the cart 12. A compartment 53 formed by a horizontal partition 49 is adapted for storage of cleaning supplies such as scrapers, bottles and paper products.

Figure 5:
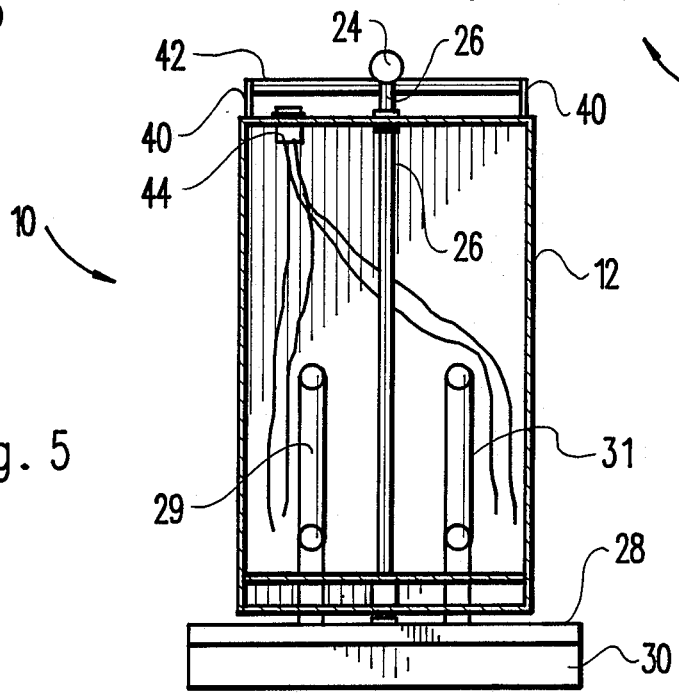
FIG. 5 is a longitudinal cross sectional view, taken along line 5—5 of FIG. 1.

As illustrated in FIG. 5, the squeegee 30 is received in a carrier 28 which is connected at a lower end of an elongated rod 26 which extends vertically through the cart 12. The switch 44 is operatively connected by the illustrated electrical wires to the battery power source illustrated in FIG. 3 and the vacuum motors illustrated in FIG. 4.

Figure 6:
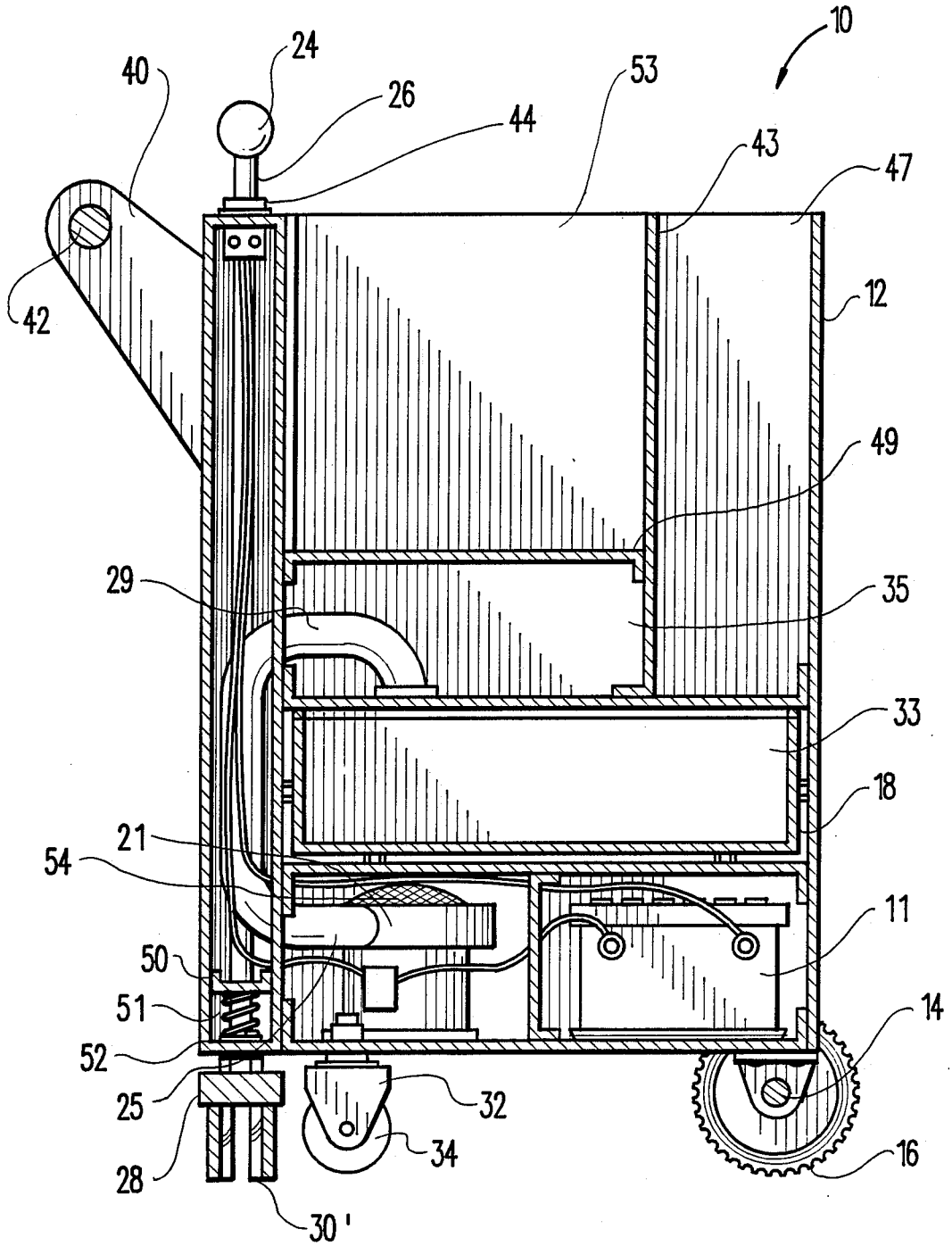
FIG. 6 is a transverse cross sectional view, taken along line 6—6 of FIG. 4, illustrating the vacuum cleaning device configured for a dry vacuuming operation.

As shown in FIG. 6, a fixed bracket 50 is provided within the housing 12 and serves as an abutment surface for an upper end of a coil spring 51 which surrounds the rod 26. A lower end of the spring 51 abuts a flange 52 secured to the rod 26, and thus downwardly biases the carrier 28 and squeegee 30'. The squeegee 30' is preferably constructed from a felt material for use in dry vacuuming cleaning operations. The vacuum cleaning motors are provided with a filter 54 for use during dry vacuuming operations.

Figure 7:
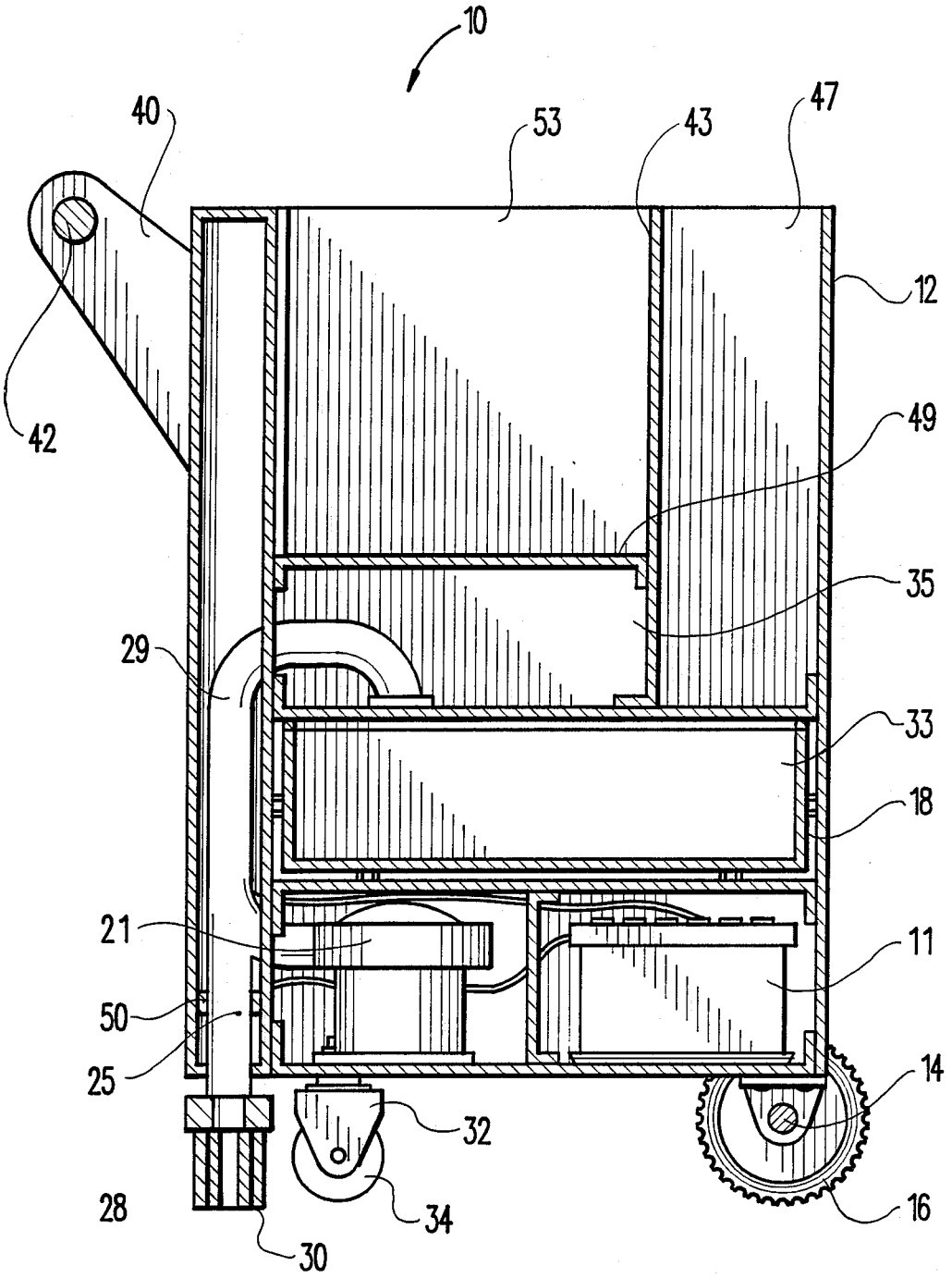
FIG. 7 is a transverse cross sectional view, taken along line 7—7 of FIG. 4, illustrating the vacuum cleaning device configured for a wet vacuuming operation.

As shown in FIG. 7, for use in wet vacuuming operations the squeegee 30 is preferably formed from a strip of a rubber material and the vacuum cleaning motor filters are removed.

Figure 8:
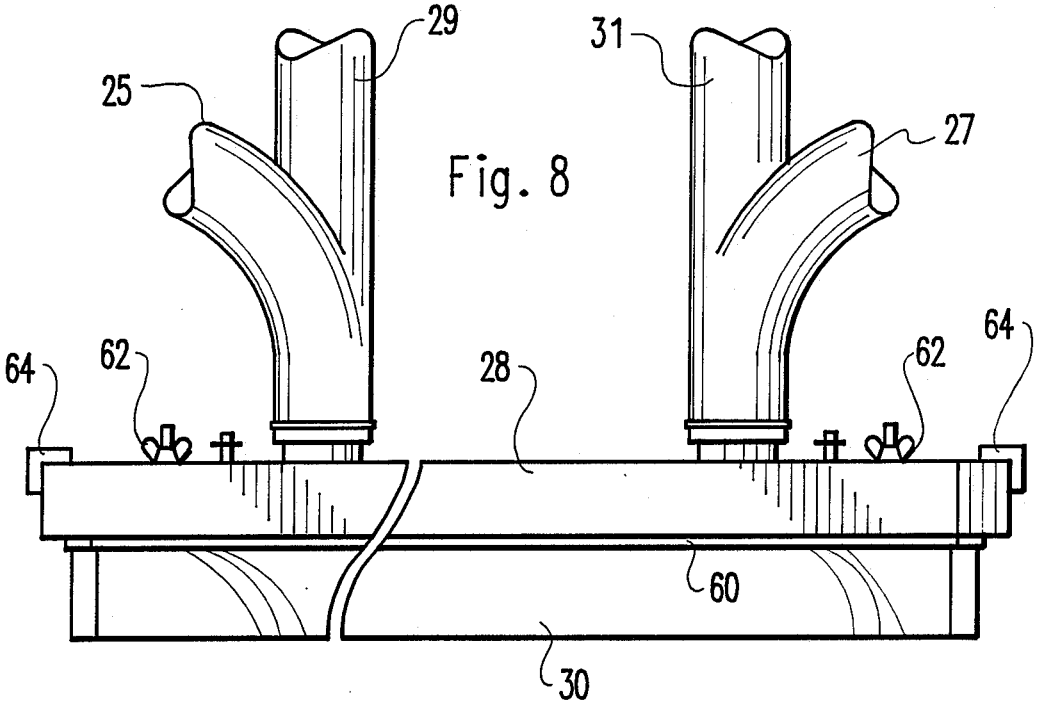
FIG. 8 is a detail view of the squeegee assembly.

A detail view of the squeegee assembly is illustrated in FIG. 8. A permanent holding bracket 28 includes guide bars 60 for locating a replaceable cartridge including squeegee wiping elements 30, which may be either felt or rubber, as described previously. The replaceable cartridge is retained by threaded fasteners 62. Bumpers 64 may be provided on side corner portions of the bracket 28 to protect wall surfaces from damage.

Figure 9:
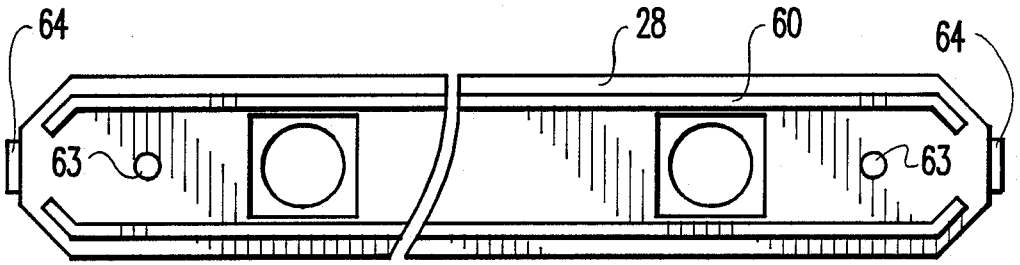
FIG. 9 is a bottom view of the squeegee mounting frame.

FIG. 9 is a bottom view of the bracket 28, with the cartridge removed. Apertures 63 are provided for reception of threaded securing fasteners.

Figure 10:
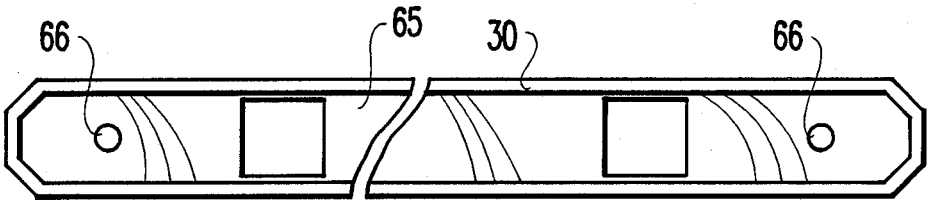
FIG. 10 is a bottom view of a replaceable squeegee cartridge.

FIG. 10 is a bottom view of the replaceable cartridge, which includes wiping elements 30 secured on a mounting plate 65. Apertures 66 are aligned with apertures 63 (FIG. 9) on the bracket 28 and receive fasteners 62 (FIG. 8) to complete the squeegee assembly.

As may now be understood, the present invention provides a utility cleaning cart which includes a pair of battery powered vacuum cleaning motors which are convertible between wet and dry operations. This provides an extremely flexible cleaning appliance which may be used in environments where AC electrical power is not available. The present invention provides a single integrated appliance which may be utilized by janitorial service workers to efficiently perform a wide variety of cleaning operations.

With respect to the above description then, it is to be realized that the optimum dimensional relationships for the parts of the invention, to include variations in size, materials, shape, form, function and manner of operation, assembly and use, are deemed readily apparent and obvious to one skilled in the art, and all equivalent relationships to those illustrated in the drawings and described in the specification are intended to be encompassed by the present invention.

Therefore, the foregoing is considered as illustrative only of the principles of the invention. Further, since numerous modifications and changes will readily occur to those skilled in the art, it is not desired to limit the invention to the exact construction and operation shown and described, and accordingly, all suitable modifications and equivalents may be resorted to, falling within the scope of the invention.

What is claimed as being new and desired to be protected by Letters Patent of the United States is as follows:

1. In a vacuuming device, the improvement comprising:

a generally rectangular squeegee carrier;

a pair of suction intake conduits communicating with respective intake apertures in said carrier;

a pair of parallel guide bars on an undersurface of said carrier;

a replaceable cartridge including wiping elements secured about a periphery of a mounting plate, said mounting plate dimensioned to be received between said guide bars; and means for securing said cartridge to said carrier.

* * * * *